US007136057B2

(12) United States Patent
Senda et al.

(10) Patent No.: US 7,136,057 B2
(45) Date of Patent: Nov. 14, 2006

(54) DISPLAY DEVICE

(75) Inventors: Michiru Senda, Gifu (JP); Ryoichi Yokoyama, Ogaki (JP)

(73) Assignee: Sanyo Electric Co., Ltd., Osaka (JP)

( * ) Notice: Subject to any disclaimer, the term of this patent is extended or adjusted under 35 U.S.C. 154(b) by 375 days.

(21) Appl. No.: 10/122,136

(22) Filed: Apr. 15, 2002

(65) Prior Publication Data

US 2002/0167501 A1 Nov. 14, 2002

(30) Foreign Application Priority Data

Apr. 13, 2001 (JP) ..... 2001-115376

(51) Int. Cl.
*G09G 5/00* (2006.01)
*G09G 3/36* (2006.01)

(52) U.S. Cl. ..... 345/211; 345/76; 345/87

(58) Field of Classification Search ..... 345/87–104, 345/200, 205, 206, 211, 212; *G09G 3/36*
See application file for complete search history.

(56) References Cited

U.S. PATENT DOCUMENTS 4,909,602 A * 3/1990 Kaneko et al. ..... 349/42
5,471,225 A 11/1995 Parks
5,691,783 A * 11/1997 Numao et al. ..... 349/48
5,712,652 A 1/1998 Sato et al.
5,945,972 A 8/1999 Okumura et al.
5,952,991 A * 9/1999 Akiyama ..... 345/98
6,452,589 B1 * 9/2002 McKnight ..... 345/205
6,765,549 B1 * 7/2004 Yamazaki et al. ..... 345/80

FOREIGN PATENT DOCUMENTS

| | | |
|---|---|---|
| EP | 0 965 976 | 12/1999 |
| EP | 1 020 840 | 7/2000 |
| EP | 1 204 089 | 5/2002 |
| JP | 60-64395 | 4/1985 |

* cited by examiner

*Primary Examiner*—Alexander Eisen
(74) *Attorney, Agent, or Firm*—Morrison & Foerster LLP

(57) ABSTRACT

A display device capable of analog and digital image display has a retaining circuit holding an image signal disposed for each of the pixel elements. In the memory operation mode, an output from an oscillation unit formed inside the display panel is supplied to the pixel element electrodes of the display. The on-resistance of an output transistor for the pixel electrode is higher than the on-resistance of thin film transistors of the inverters in the oscillation unit. In the memory operation mode, gate and drain lines are set at predetermined voltages and an output of a voltage booster circuit formed in the display panel is used as a reference voltage of the retaining circuit and used for switching a selection circuit selecting image display circuits.

13 Claims, 4 Drawing Sheets

DISPLAY DEVICE

BACKGROUND OF THE INVENTION

1. Field of the Invention

This invention relates to an active matrix display device, specifically to an active matrix display device in which a plurality of retaining circuits is provided.

2. Description of the Related Art

There has been a great demand on the market for portable devices with a display such as a portable TV and a portable telephone. All these devices need a small, lightweight and low power consumption display device. Development efforts have been made accordingly. A liquid crystal display device having a static memory (Static Random Access Memory; SRAM) for each of the pixel elements for displaying a still picture is disclosed in Japanese Patent Application No. 2000-282168.

SUMMARY OF THE INVENTION

The invention provides an active matrix display devise including a plurality of gate signal lines disposed in one direction on a substrate and a plurality of drain signal lines disposed in a direction different from the direction of the gate signal lines. The device has a plurality of pixel element electrodes which are selected in response to a scanning signal fed from one of the gate signal lines and are provided with an image signal fed from one of the drain signal lines. A plurality of retaining circuits are disposed corresponding to the pixel element electrodes. Each of the retaining circuits retains a voltage according to the image signal. A plurality of circuit selection transistors are disposed between the corresponding retaining circuits and the corresponding pixel element electrodes. The display device has a normal operation mode in which voltages corresponding to the image signal are supplied to the pixel element electrodes to form an analogue image, and a memory operation mode in which voltages corresponding to the voltages retained in the retaining circuits are supplied to the corresponding pixel element electrodes to form a digital image. The circuit selection transistors turn on in the memory operation mode. The voltages supplied to the pixel element electrodes in the memory operation mode are supplied to the pixel element electrodes through the circuit selection transistors. A voltage applied to gates of the circuit selection transistors is higher than the highest voltage supplied to the pixel element electrodes in the memory operation mode.

The invention also provides an active matrix display devise including a plurality of gate signal lines disposed in one direction on a substrate and a plurality of drain signal lines disposed in a direction different from the direction of the gate signal lines. The device has a plurality of pixel element electrodes which are selected in response to a scanning signal fed from one of the gate signal lines and are provided with an image signal fed from one of the drain signal lines. A plurality of retaining circuits are disposed corresponding to the pixel element electrodes. Each of the retaining circuits retains a voltage according to the image signal. The device also has a plurality of data output transistors. The outputs of the retaining circuits are supplied to the gates of corresponding data output transistors. The display device has a normal operation mode in which voltages corresponding to the image signal are supplied to the pixel element electrodes to form an analogue image, and a memory operation mode in which the data output transistors turn on according to the voltages retained by the corresponding retaining circuits and a predetermined voltage is applied to the pixel element electrodes through the data output transistors. A voltage applied to gates of the data output transistors is higher than the highest voltage supplied to the pixel element electrodes in the memory operation mode.

DETAILED DESCRIPTION OF THE INVENTION

This invention is directed to a display device, which can alternate between two kinds of display modes, an analog display mode and a digital display mode, as described in commonly owned copending U.S. patent application Ser. No. 09/953,233, entitled "DISPLAY DEVICE AND ITS CONTROL METHOD." The disclosure of U.S. patent application Ser. No. 09/953,233 is, in its entirety, incorporated herein by reference.

Figure 5:
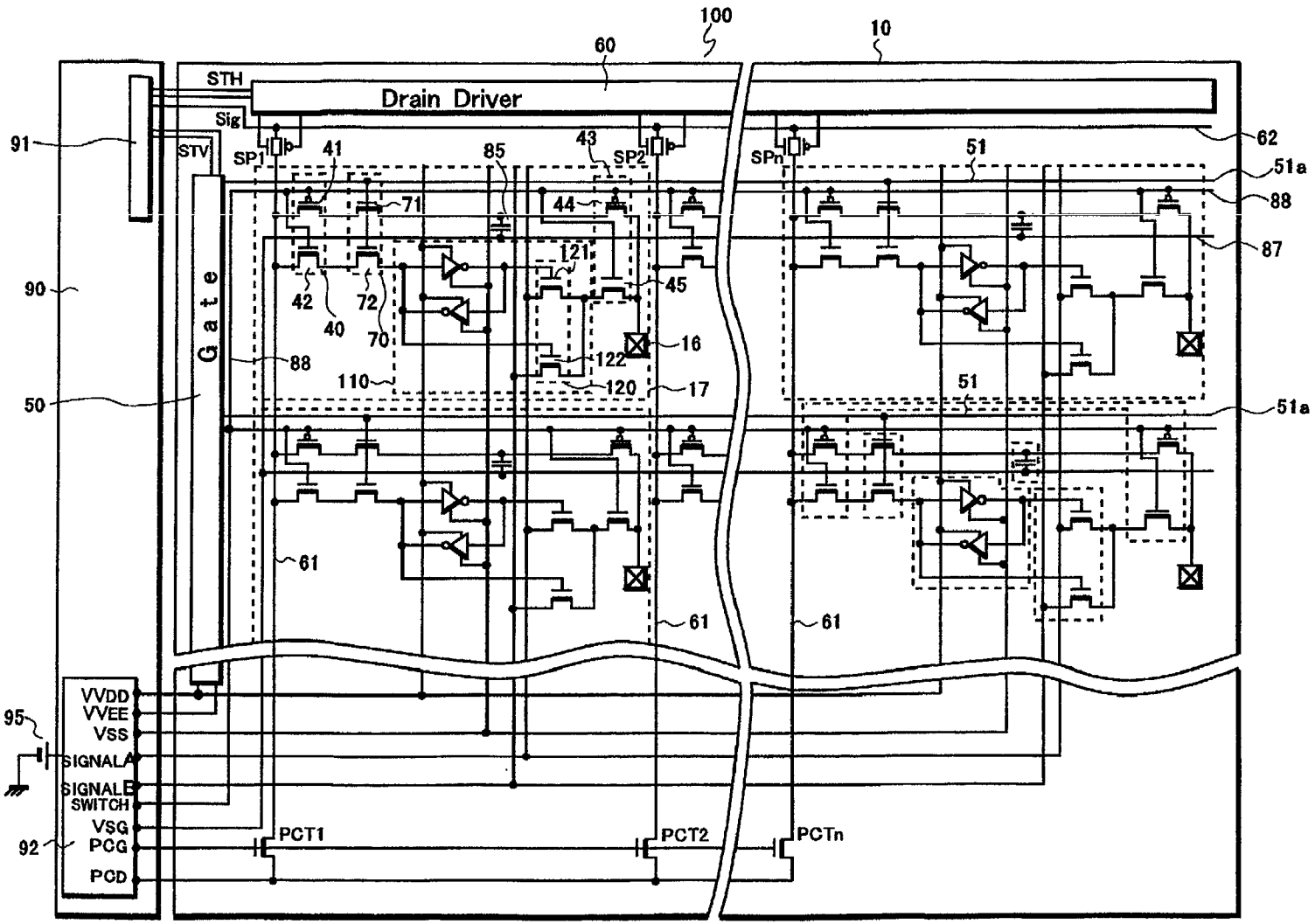
FIG. 5 is a circuit diagram of a active matrix display device which forms a basis of this invention.

FIG. 5 shows a circuit diagram of a liquid crystal display device (LCD), which forms a basis of this invention. On a liquid crystal display panel 100, a plurality of pixel element electrodes 17 is disposed on an insulating substrate 10 in a matrix configuration. A plurality of gate signal lines 51 connected to a gate driver 50 supplying a gate signal is disposed in one direction. And the plurality of drain signal lines 61 are disposed in a direction perpendicular to the gate signal lines 51.

In response to the timing of a sampling pulses outputted from a drain driver 60, the respective sampling transistors SP1, SP2, - - - SPn, sequentially turn on, and a data signal of a data signal line 62 (analog image signal or digital image signal) is supplied to the drain signal lines 61.

The gate driver 50 selects one of gate signal lines 51 and supplies the gate signal to this gate signal line. The drain signal line 61 supplies the signal to the pixel element electrode 17 of the selected row.

The detailed configuration of the pixel element will be explained hereinafter. A circuit selection circuit 40 comprising a P channel circuit selection TFT 41 and an N channel circuit selection TFT 42 is formed near the crossing of the gate signal line 51 and the drain signal line 61. Both drains of the TFTs 41, 42 are connected to the drain signal line 61, and both gates are connected to a circuit selection signal line 88. The circuit selection TFTs 41, 42 complementarily turn on based on the selection signal fed from the circuit selection signal line 88. Also, a circuit selection circuit 43 is formed, making a pair with the circuit selection 25 circuit 40. The transistor of each of the circuit selection circuits 40, 43 should operate complementarily, and the N channel and the P channel of these circuits are interchangeable.

Therefore, the selection and the switching between an analog image signal display (full color motion picture), which is a normal operation mode described later, and a digital image display mode, which is a memory operation mode (low power consumption, for still image display) is possible. Also, a pixel element selection circuit 70 comprising an N channel pixel element selection TFT 71 and an N channel TFT 72 is formed adjacent to the circuit selection circuit 40. The pixel element selection TFTs 71 and 72 are connected to the circuit selection TFTs 41 and 42 of the circuit selection circuit 40 in series, respectively. Also, both gates of the TFTs 71, 72 are connected to the gate signal line 51. Both of the TFTs 71 and 72 turn on simultaneously in response to the gate signal fed from the gate signal line 51.

A storage capacitance element 85 for holding an analog image signal is formed. One terminal of the storage capacitance element 85 is connected to a source of the TFT 71. The other terminal is connected to a commonly used storage capacitance line 87 and is provided with a bias voltage Vsc. Also, the source of the pixel element selection TFT 71 is connected to the pixel element electrode 17 through a contact 16 and the circuit selection TFT 44. When the gate of the pixel element selection TFT 71 opens by the gate signal, the analog image signal supplied from the drain signal line 61 is inputted to the pixel element electrode 17 through the contact 16, and drives the liquid crystal as a pixel element voltage. The pixel element voltage should be retained for one field period from the release of the selection to the re-selection of the pixel element TFT 71. However, the capacity of the liquid crystal alone cannot retain the pixel element voltage for one field period, resulting in a loss of the homogeneity of the display image. The storage capacitance element 85 maintains the applied voltage at its initial level during one field period for eliminating the problem above. The storage capacitance element 85 comprises a pair of electrodes facing each other and occupying a certain amount of area. One of the electrodes is a semiconductor layer which extends to form the source of the pixel element selection TFT 71. The other electrode is the storage capacitance line 87. The storage capacitance line 87 is connected with a plurality of the pixel elements in the row direction and provided with the voltage VSC.

Between the storage capacitance element 85 and the pixel element electrode 17, a P channel TFT 44 of the circuit selection circuit 43 is formed, turning on and off simultaneously with the circuit selection TFT 41 of the circuit selection circuit 40. The operation mode, in which the circuit selection TFT 41 is on and the analog signal is consecutively supplied to drive the liquid crystal, is called a normal operation mode or an analog operation mode.

Between a TFT 72 of the pixel element selection circuit 70 and the pixel element electrode 17, a retaining circuit 110 is formed. The retaining circuit 110 comprises two inverter circuits which are positively fed back to each other, making a SRAM retaining binary digital signal.

The signal selection circuit 120 selects the signal based on the signal from the two inverters, and comprises two N channel TFTs 121, 122. Since the complementary output signal from the two inverters is applied to the gates of the TFTs 121, 122, the TFTs 121, 122 complementarily turn on and off.

Here, a common electrode signal VCOM (signal A), where the AC voltage is selected when the TFT 121 turns on, and the AC drive signal (signal B) for driving the liquid crystal with AC voltage relative to the common electrode signal VCOM, is selected when the TFT 122 turns on. The selected signal is then applied to the pixel element electrode 17 of the liquid crystal through the TFT 45 of the circuit selection circuit 43 and the contact 16. The operation mode, in which the circuit selection TFT 42 is on and an image is formed based on the signal retained in the retaining circuit 110, is called a memory operation mode or a digital operation mode.

In short, an analog display circuit and a digital display circuit are formed in single pixel element. The analog display circuit has the pixel element selection TFT 71, which is the pixel element selection element, and the storage capacitance element 85 for retaining the analog image signal. The digital display circuit has the TFT 72, which is the pixel element selection element, and the retaining circuit 110 for retaining the binary digital image signal. Furthermore, the circuit selection circuits 40, 43, for selecting these two circuits, are also formed.

The liquid crystal display panel 100 has peripheral circuits as well. A drive signal generator circuit 91, the voltage booster circuit 92, and the voltage generating circuit 93 are formed on an external circuit board 90 externally added to the insulating substrate 10. Also, a battery 95 is connected to the external circuit board 90.

The battery 95 outputs the battery voltage VB. The voltage booster circuit 92 raises VB to an elevated voltage VVDD. The voltage generating circuit 93 outputs a predetermined voltage to each of the wiring connected to each part of the LCD panel 100. For example, the elevated voltage VVDD is used as a positive drive voltage of the gate driver 50. Also, an ascended negative voltage VVEE is used as a negative drive voltage of the gate driver. A reference voltage VSS is usually connected to the ground. The signals A and B are the voltages selected by the voltage retained by the retaining circuit 110 and applied to the liquid crystal. PCG and PCD are the signals for pre-charging the drain signal line 61. Also, a vertical start signal STV is inputted from the drive signal generator circuit 91 to the gate driver 50. A horizontal start signal STH is inputted to the drain driver 60. The image signal is inputted to the data signal line 62.

Next, the driving method of the display device with the above configuration will be explained.

(1) Normal operation mode (Analog operation mode).

When the analog display mode is selected according to a mode signal, the drive signal generator circuit 91 is set to supply the analog signal to the data signal line 62 and the voltage of the circuit selection signal line 88 becomes "L" (low), turning on the P channel circuit selection TFTs 41, 44 and turning off the N channel circuit selection TFTs 42, 45 of the circuit selection circuits 40, 43.

The sampling transistors SP1, SP2, - - - SPn, sequentially turn on in response to the sampling signal that is based on the horizontal start signal STH so that the analog image signal is supplied from the data signal line 62 to the drain signal line 61.

Also, the gate signal is supplied to the gate signal line 51 in accordance with the vertical start signal STV. When the pixel element selection TFT 71 turns on in response to the gate signal, the analog image signal An.Sig is applied to the pixel element electrode 17 through the drain signal line 61 and retained in the storage capacitance element 85. The liquid crystal aligns itself in accordance with the image signal voltage fed from the pixel element electrode 17 and applied to the liquid crystal, resulting in the liquid crystal display.

Since the capacitance of the drain signal line 61 is large, it is difficult to supply the image signal instantly. Therefore, from the pre-charge transistors PCT1, PCT2, - - - PCTn, the predetermined voltage of the pre-charge signal PCD is supplied to each of the drain signal lines 61. The pre-charge transistors turn on by the pre-charge control signal PCG for each horizontal retrace interval.

In the analog display mode, the liquid crystal is sequentially driven by the analog signal sequentially inputted. Thus, this display mode is suitable for full-color moving picture. However, the power for driving the drive signal generator circuit 91 on the external circuit board 90 and the drivers 50, 60 is continuously consumed.

(2) Memory operation mode (Digital display mode)

When the digital display mode is selected based on the mode signal, the drive signal generator circuit 91 is set to output the digital signal, which is formed by converting the image signal into the digital signal and extracting the top one bit, to the data signal line 62. Also, the voltage of the circuit selection signal line 88 turns to high, the circuit selection TFTs 41, 44 of the circuit selection circuits 40, 43 turn off, and the circuit selection TFTs 42, 45 turn on, making the retaining circuit 110 operable.

The drive signal generator circuit 91 on the external circuit board 90 sends the start signals STV, STH to the gate driver 50 and the drain driver 60, respectively. In response to the start signals, the sampling signals are sequentially generated. In response to each of the sampling signals, the respective sampling transistors SP1, SP2, - - - SPn sequentially turn on, thereby sampling the digital image signal D.Sig and sending it to each of the drain signal lines 61.

Next, the retaining circuit 110 will be described. First, the gate signal G1 turns on each pixel element selection TFT 72 of the pixel element connected to the gate signal line 51 for one horizontal scanning period. In the pixel element located at the upper left corner of the matrix, the sampling signal SP1 takes in the digital image signal S11 and feeds it to the drain signal line 61. When the gate signal turns on the pixel element selection TFT 72, the digital image signal D.Sig is inputted to the retaining circuit 110, where the two inverters retain the signal.

The signal retained by the retaining circuit 110 is then fed to the signal selection circuit 120, and is used by the signal selection circuit 120 to select either signal A or signal B. The selected signal is then applied to pixel element electrode 17 and its voltage is then applied to the liquid crystal.

Thus, upon the completion of the scanning from the first gate signal line on the top row of the matrix to the last gate signal line on the bottom row of the matrix, the scanning of the full display frame scan (one field scan) is completed.

When one display image appears, the voltage supply to the drivers 50, 60, and the drive signal generator circuit 91 on the external circuit board 90 is halted. This stops the drive of these circuits. The elevated voltage VVDD and the reference voltage VSS are continuously provided to drive the retaining circuit 110 as the reference voltage. Also, the common electrode voltage is supplied to the common electrode. Signal A and signal B are provided to the circuit selection circuit 120.

The retaining circuit 110 receives the VVDD and VSS for its driving and the common electrode receives the common electrode voltage VCOM. When the liquid crystal display panel 100 is in the normally-white (NW) configuration, the same voltage as the common electrode voltage, which is the AC drive voltage, is applied to the signal A. Only the AC voltage (for example, 60 Hz, 30 Hz) for driving the liquid crystal is applied to the signal B. In this way, the data (voltages corresponding to the image signal) for one still picture is retained and displayed. In this case, the voltage is not supplied to the drivers 50, 60 or the drive signal generator circuit 91.

When the retaining circuit 110 receives the digital image signal of "H"(high) through the drain signal line 61, the first TFT 121 of the signal selection circuit 120 receives the "L"(low) signal and, accordingly, turns off. The second TFT 122 receives the high signal and turns on. In this case, the signal B is selected and the voltage of the signal B is applied to the liquid crystal. That is, the AC voltage of the signal B is applied, resulting in rearrangement of the liquid crystal 21. Since the display panel is in the NW mode, the black image results.

When the retaining circuit 110 receives the low digital image signal through the drain signal line 61, the first TFT 121 of the signal selection circuit 120 receives the high signal and, accordingly, turns on, and the second TFT 122 receives the low signal and turns off. In this case, the signal A is selected and the voltage of the signal A is applied to the liquid crystal. That is, since the same voltage as the common electrode is applied, there is no change in the arrangement of the liquid crystal 21. The white image results in the display panel in the NW mode.

In this manner, the signals corresponding to one field are written and retained, and the still image is displayed based on the signals. In this case, the drive of the drivers 50, 60 and the drive signal generator circuit 91 is halted, resulting in the significant reduction of power consumption.

Figure 1:
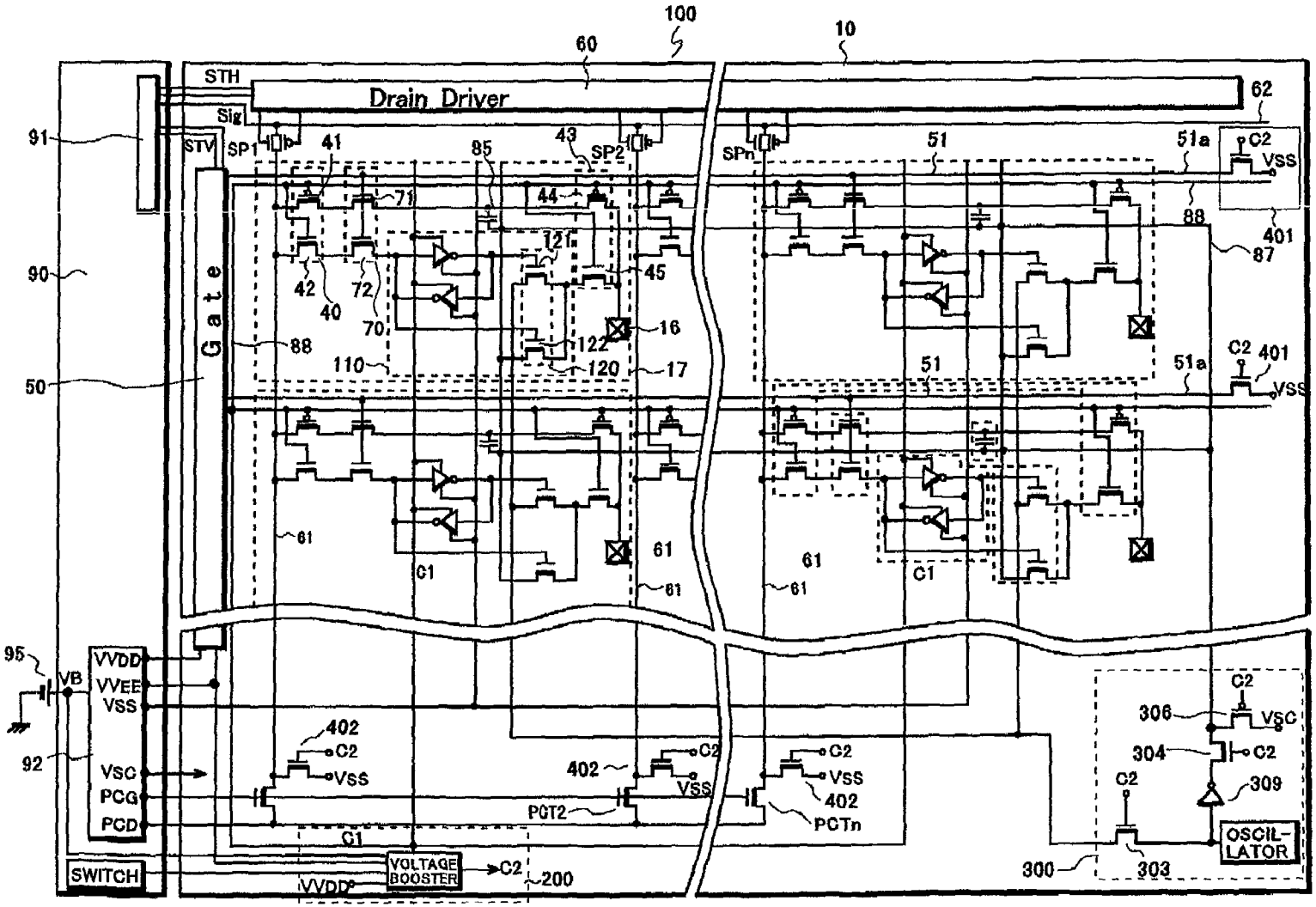
FIG. 1 is a circuit diagram of an active matrix display device of an embodiment of this invention.

Next, the display device of an embodiment of this invention is explained. FIG. 1 shows the circuit diagram of the display device of this invention applied to the liquid crystal display device. The pixel element part of this invention is approximately the same as that of the device of FIG. 5. That is, in this embodiment, the selection between the analog operation circuit having the selection TFT 71 and the storage capacitance element 85, and the memory operation circuit having the retaining circuit 110, is made by circuit selection circuits 40, 43. The image is displayed according to the selected operation mode. In the same configuration as the device of FIG. 5, the same reference numerals will be used, and the detailed explanation will be omitted.

The display device of this embodiment largely differs from the display device of the FIG. 5 in that the former has the voltage booster circuit 200, the oscillation unit 300, and earth switches 401, 402 in the LCD panel 100. Although the display device of this invention is the same as the display device of the FIG. 5 in that the high and low power supply voltages are inputted to the retaining circuit, they differ from each other in that the output C1 from the voltage booster circuit 200 is supplied to the retaining circuit as a high power supply voltage in this embodiment. A reference voltage VSS, which is preferably a ground voltage, is used as a reference voltage or a low power supply voltage, in this embodiment.

Figure 2:
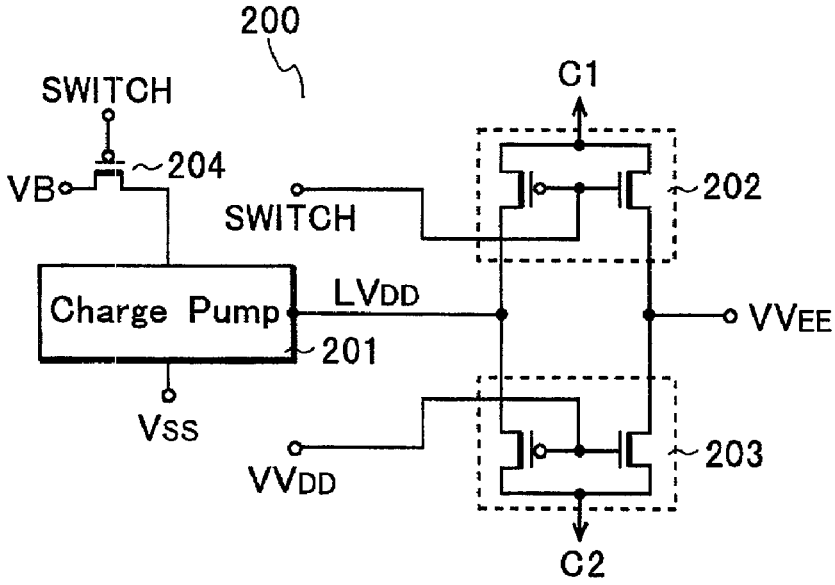
FIG. 2 is a circuit diagram of a voltage booster circuit of the embodiment of FIG. 1.

The voltage booster circuit 200 will be described. FIG. 2 shows a detailed circuit diagram of the voltage booster circuit 200. The voltage booster circuit 200 has a charge pump 201 provided with a battery voltage VB and a reference voltage VSS, a first switching circuit 202 provided with a switching signal, a second switching circuit 203 provided with an elevated voltage VVDD, and a transistor 204.

The charge pump 201 receives the power supply voltage VB, elevates it to a predetermined voltage LVDD, and outputs the elevated voltage. The gate electrodes of the P channel transistor and the N channel transistor of the first switching circuit 202 are provided with the switching signal. Based on the switching signal, the first switching circuit 202 selects between the charge pump output LVDD and the negative voltage VVEE and outputs it as a first control signal C1. The gate electrodes of the P channel transistor and the N channel transistor of the second switching circuit 203 are provided with the VVDD. Based on the VVDD, the second switching circuit 203 selects between the charge pump output LVDD and the negative voltage VVEE and outputs it as a second control signal C2.

The first control signal C1 of the booster circuit 200 is supplied as the gate voltage of the circuit selection circuits 40, 43 and also as the high voltage reference voltage of the retaining circuit 110. The second control signal C2 is supplied to each transistor of a oscillation unit 300, an earth switch 401, and an earth switch 402 as the gate voltage.

Figure 3:
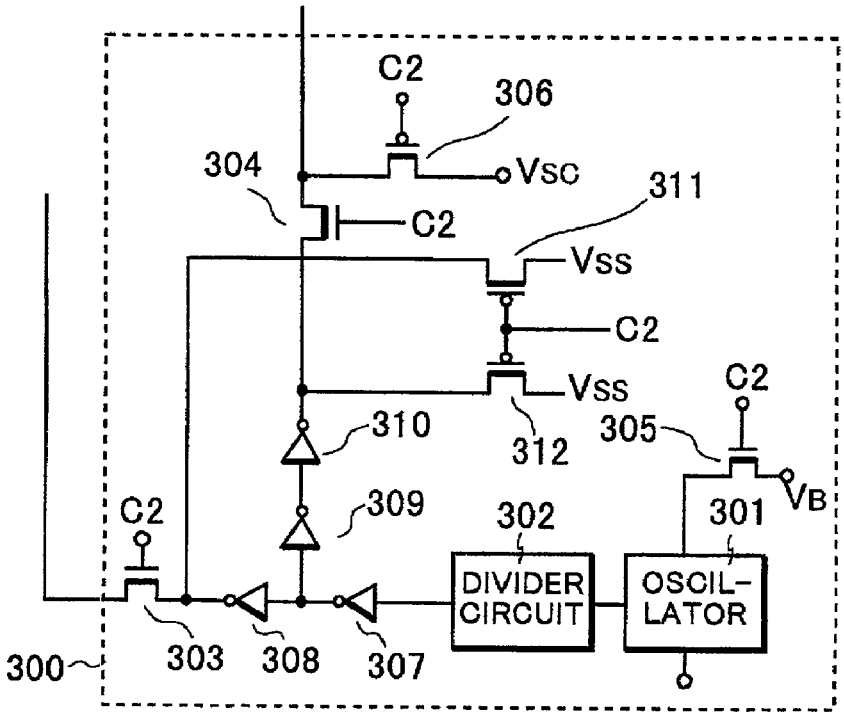
FIG. 3 is a circuit diagram of an oscillation unit of the embodiment of FIG. 1.

Next, the oscillation unit 300 will be described. FIG. 3 is a detailed circuit diagram of the oscillation unit 300. The oscillation unit 300 has an oscillator 301, a divider circuit 302, and a plurality of the inverters 307, 308, 309, 310. The oscillator 301 outputs the square wave of, for example, 120 Hz. The divider circuit 302 divides the output frequency of the oscillator 301 by four, mad outputs the square wave of 30 Hz. The output from the divider circuit 302 is inverted twice by the inverters 307, 308, and then outputted as the first AC signal through the first output transistor 303. Also, the output from the divider circuit 302 is inverted three times by the inverters 307, 309, 310 and then outputted as the second AC signal through the second output transistor 304. The first and second AC signals are the square waves inverted from each other.

Figure 4:
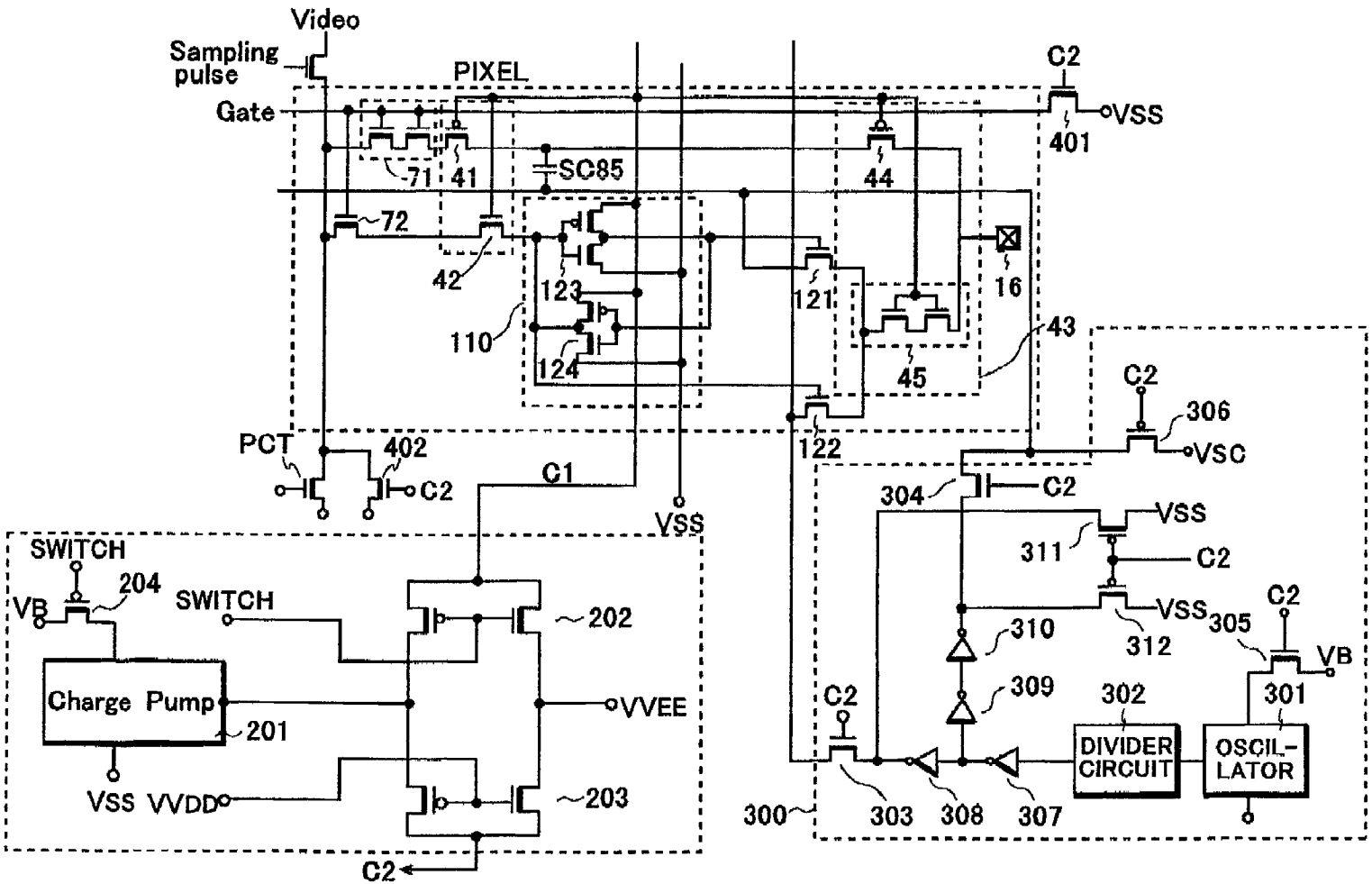
FIG. 4 is a circuit diagram showing the details of the voltage booster circuit and the oscillation unit of FIG. 1.

Next, the operation of this embodiment in three different modes will be explained by referring to FIG. 4. In FIG. 4, the detailed circuit diagrams of the voltage booster circuit 200 and the oscillation unit 300 are shown along with the circuit diagram of the one of the pixel elements shown in FIG. 1. In this figure, the other pixel elements are omitted for the sake of simplicity.

(1) Normal operation Mode

In the normal operation mode, the voltage booster circuit 92 of the external circuit board 90 is in operation and a predetermined voltage VVDD is outputted as a positive drive voltage of the gate driver 50. In the normal operation mode, the gate driver 50 and the drain driver 60 operate based on the different types of timing signals outputted from the drive signal generator circuit 91. When the switching signal is high, the first switching circuit 202 of the voltage booster circuit 200 selects the negative voltage VVEE and outputs it as the first control signal C1, turning on the P channel circuit selection TFTs 41, 44 and turning off the N channel circuit selection TFTs 42, 45. Therefore, when the pixel element selection TFT 71 is on in accordance with the gate signal, the analog image signal An.Sig is transmitted to the pixel element electrode 17 and the storage capacitance element 85 through the drain signal line 61, displaying an image.

Since the retaining circuit 110 is provided with the first control signal C1 as a high reference voltage, the voltage retained by the retaining circuit 110 is deleted and the operation of the retaining circuit is halted. In the normal operation mode, the retaining circuit 110 is not necessary. Thus, the signal can be shared with the gate electrode of the circuit selection circuits 40, 43, reducing the required area in the pixel element. Also, the transistor 204, which supplies the battery voltage VB as a power source to the charge pump 201, turns off based on the switching signal. Thus, the charge pump 201 also stops operating. This reduces the operation current for the charge pump 201 as well as current leakage from the circuit.

Also, since the VVDD is high, the second switching circuit 203 also selects the negative voltage VVEE and outputs it as the second control signal C2, turning off the first and second output transistors 303, 304 of the oscillation unit 300, and the earth switches 401, 402. Since the transistor 305, which supplies the power supply voltage to the oscillator 301, turns off, the oscillator 301 halts its operation, leading to a reduction of the operation current of the oscillator 301. On the other hand, the third transistor 306 of the oscillation unit 300 turns on, supplying the predetermined voltage VSC to the electrode of the storage capacitance element 85.

The oscillation unit 300 is used in the memory operation mode as described later, but not used in the normal operation mode. However, if only the transistors 303, 304 are turned off, a part of the circuit elements in the oscillation unit may become electrically floating. The voltage of the part of these circuit elements may change due to the operation of the surrounding circuits, giving unexpected noise to the display. Therefore, a pair of the P channel transistors 311 and 312, to whose gate the second control signal C2 is inputted, is provided in this embodiment. The transistors 311, 312 turn on in the normal operation mode and prevent the influence of the unexpected noise by putting the circuit elements of the oscillation unit 300 into a ground voltage. The position for connecting to the transistors 311, 312 can be any position where there is floating in the normal operation mode among the circuits forming the oscillation unit 300. However, if they are connected at the position between the inverters at the most output side 308, 310 and the output transistors 303, 304 of the oscillation unit 300, the noise can be most effectively prevented.

(2) Retaining circuit writing mode

In the retaining circuit writing mode, a voltage booster circuit 92 of the external circuit board 90 is in operation and a predetermined voltage VVDD is outputted as a positive drive voltage of the gate driver 50. The gate driver 50 and the drain driver 60 are in operation based on the different types of timing signals. The switching signal is changed to low. Then the transistor 204 of the voltage booster circuit 200 turns on and the charge pump 201 starts operating. The first switching circuit 202 outputs the output of the charge pump 201 as the first control signal C1, turning off the P channel circuit selection TFTs 41, 44 and turning on the N channel circuit selection TFTs 42, 45. The power supply voltage of the retaining circuit 110 also turns on, operating the retaining circuit 110. Based on the control of the gate driver 50 and the drain driver 60, the signal (voltage) based on the image signal is sequentially written into the retaining circuit of each of the pixel elements.

In the retaining circuit writing mode, the VVDD (high) is outputted from the voltage booster circuit 92. Thus, the second control signal C2 outputted from the voltage booster circuit 200 stays at low. Therefore, the transistors 303, 304, 305 of the oscillation unit 300 stay off.

(3) Memory operation mode

In the memory operation mode, the drive signal generator circuit 91 and the voltage booster circuit 92 on the external circuit board 90 stop the operation. Therefore, the driver voltage VVDD of the gate driver 50 becomes low, stopping the operation of the gate driver 50 and the drain driver 60. Since the switching signal stays high, the circuit selection circuits 40, 43 select the retaining circuit 110, and the display device produces the display based on the voltage retained by the retaining circuit 110.

In this embodiment, the drive signal generator circuit 91 and the voltage booster circuit 92 on the external circuit board 90 completely stop their operation in the memory operation mode, generating no output. Only the battery voltage VB outputted from the battery 95 is directly supplied to the liquid crystal display panel 100. The battery voltage VB is ascended by the voltage booster circuit 200 in the liquid crystal display panel 100, and used as the reference voltage supplied to the retaining circuit. Therefore, it is possible to completely stop the voltage supply to the external circuit board 90, leading to the considerable reduction of the power consumption in the memory operation mode.

Also, the VVDD becomes low as the external voltage booster circuit 92 stops the operation. Thus, the second switching circuit 203 of the voltage booster circuit 200 is switched to select the output of the charge pump 201 and output it as the second control signal C2. Therefore, the transistor 305, supplying the power supply voltage to the oscillator, 301 turns on, starting the operation of the oscillator 301. The output from the oscillator 301 is divided by the divider circuit 302, inverted by the inverters 307–310, and then outputted through the transistor 303, 304. At the same time, the transistor 306 turns off. The output of the transistor 303 is a first AC signal, and the output of the transistor 304 is a second AC signal. The first and second AC signals are in opposite phases with a 180-degree phase difference. The retaining circuit 110 turns on one of the transistors 121, 122 and turns off the other in accordance with the voltage retained by the retaining circuit 110. Therefore, when the transistor 122 is on, the first AC signal is applied, and when the transistor 121 is on, the second AC signal is applied to the liquid crystal, respectively. The second AC signal is also applied to the common electrode (not shown) as a common electrode signal VCOM. Therefore, at the pixel element whose transistor 121 is selected, the liquid crystal is not driven, resulting in the 'black' display in normally black mode.

When the voltage VSC supplied to the common electrode in the normal operation mode is electrically floating in the memory operation mode, the transistor 306 is not needed. However, the VSC is supplied from the external circuit board 90 through the wiring connected to the external circuit board 90. It is possible that this wiring picks up noise, which may disrupt the operation. Therefore, it is preferable to provide the transistor 306.

In this embodiment, the drive signal generator circuit 91 and the voltage booster circuit 92 on the external circuit board 90 completely stop their operation in the memory operation mode. The voltage applied to the liquid crystal is generated by the oscillation unit 300 formed on the liquid crystal display panel 100 using the battery voltage VB. Therefore, it is possible to completely stop the voltage supply to the external circuit board 90, leading to the considerable reduction of the power consumption in the memory operation mode.

Next, the output voltage of the voltage booster circuit 200 in the memory operation mode will be explained. The first control signal C1, which is the output from the voltage booster circuit 200, is set to be higher than the possible highest voltage of the first and second AC signals, which are the output from the oscillation unit 300. The output from the oscillation unit 300 is inputted to the pixel element electrode 17 through the data output transistor 121 or 122 and the transistor 45 of the circuit selection circuit 43. If the gate voltage of the circuit selection transistor 45 and the data output transistors 121, 122 is lower than the voltage of the oscillation unit 300, the transistors 45, 121, 122 may not turn on. Therefore, it is necessary to set the gate voltage of these transistors 45, 121, 122 higher than the highest voltage that the oscillation unit 300 can output. In this embodiment, the gate voltage of the circuit selection transistor 45 is the output voltage of the voltage booster circuit 200, and the gate voltage for turning on the data output transistors 121, 122 is the high reference voltage of the retaining circuit, which is also the output voltage from the voltage booster circuit 200. Therefore, by setting the output voltage of the voltage booster circuit 200 higher than the possible highest voltage of the oscillation unit 300, the transistor 45 can be turned on. That is, the output voltage of the voltage booster circuit 200 should be higher than the largest output amplitude of the first and second AC signals of the oscillation unit 300 by the amount of the threshold voltage of the transistors 45, 121, 122.

The battery voltage VB affects the output amplitude of the oscillation unit 300. The output amplitude of the oscillation unit 300 determines the voltage applied to the liquid crystal. Thus, when the output amplitude obtained only from the battery voltage VB does not give enough contrast between on and off in the display, it is necessary to boost the power supply voltage of the oscillation unit 300 by putting the voltage booster circuit between the oscillator 301 and the transistor 305. In this embodiment however, by setting the battery voltage VB at 3V, enough contrast can be obtained, and therefore, there is no need to put the voltage booster circuit between the oscillator 301 and the transistor 305.

The circuit elements on the liquid crystal display panel 100 are formed using polysilicon, which is made by crystallizing amorphous silicon by laser beam radiation. The polysilicon is not uniform in terms of crystallization due to the varied output of the crystallization laser. Therefore, compared to the circuit element formed on the single crystalline semiconductor wafer, the characteristics of those formed on the polysilicon widely varies. Thus, in the oscillator 301, the balance of the output signal duty, that is, the balance between high and low, is sometimes imbalanced. When the duty is imbalanced, a voltage corresponding to a direct current component is applied to the liquid crystal, deteriorating the liquid crystal. However, in this embodiment, the output frequency from the oscillator 301 is divided by the divider circuit 302, correcting the output duty of the oscillator 301 and obtaining the output wave with a balanced duty. The first and second AC signals are set at 30 Hz in this embodiment as an example. It is sufficient to alternate the signals with a frequency that will not deteriorate the liquid crystal. Such frequency is relatively low compared to the operation frequency of the gate driver 50. In order to generate the AC output of a relatively low frequency directly from the oscillator 301, the oscillator 301 requires a large capacitance, a large resistance and an increased number of inverters. This leads to a large circuit area for the oscillator 301. However, in this embodiment, the divider circuit 302 divides the high output frequency of the oscillator. Therefore, the oscillator 301 can have a smaller capacitance, a smaller resistance, and a reduced number of inverters, leading to the reduction of the circuit area.

Next, the inverters 308, 310 will be described. The output from the divider circuit 302 is applied to the liquid crystal through the transistors 121, 122. The divider circuit 302 is disposed near the pixel element portion and its output is supplied to each of the pixel elements through wiring. This wiring is thin and long. Also, since each pixel element has capacitance due to the liquid crystal and the wiring, the divider circuit has a heavy load. When the heavy load is driven by the output from the inverter 307, the waveform of the inverter 307 becomes dull. When the output waveform from the inverter is dull, a flow-through current of the inverter passes through before the output is completely inverted, leading to increased power consumption. It may be possible to make the output waveform sharper by increasing the size of the inverter 307, but this will increase the circuit area. Adding the inverters 308, 310 can increase the current drive capability, make the output waveform sharper and suppress the through current. The more these inverters are formed, the more the through current is suppressed. In this embodiment, by setting the on-resistance of the transistors 303, 304 higher than the on-resistance of the transistors of the inverters, the through current is further suppressed. Also, in this embodiment, when the length/width ratio of the transistors 303, 304 is 1/20, the through current is smaller, reducing power consumption in the memory operation mode, compared to the case where the length/width ratio is 1/40. By setting the on-resistance of the transistors 303, 304, relatively high in this manner, the number of the inverters 308, 310 can be minimized, suppressing the increase of the circuit area. If the on-resistance of the transistor 303, 304 is large enough to suppress the through current and to make the output waveform sharp, the inverters 308, 310 can be omitted. Although it is not shown in the figure, five to ten of each of the inverters 308, 310 are formed in this embodiment.

Next, the earth transistors 401, 402 will be described. In the memory operation mode, the gate driver 50 and the drain driver 60 stop their operation, making the gate signal line 51 and the drain signal line 61 electrically float. This leads to the capacitance coupling among the circuit elements in the pixel element. Therefore, the voltage of the gate signal line 51 and the drain signal line 61 may fluctuate. The fluctuation may turn on the transistors 71, 72 in the pixel element, which should be turned off under the memory operation mode. However, in this embodiment, the gate of the earth transistors 401, 402 is provided with the second control signal C2, turning on the earth transistors 401, 402 in the memory operation mode. This puts the gate signal line 51 and the drain signal line 61 to a ground voltage, and prevents false operation due to the fluctuation of the voltage. In this embodiment, the ground voltage VSS is inputted to the earth transistors 401, 402. However, the same effect can be obtained when any arbitrary voltage, which is under the threshold voltage, is inputted to the earth transistors 401, 402, because the pixel element selection transistor 71, 72 will not turn on.

In this embodiment, the retaining circuit 110 holds only one-bit data. However, it is also possible to make the retaining circuit 110 hold multiple-bit data. In such configuration, a display with gray scale is possible in the memory operation mode. Also, if the memory circuit capable of holding the analog value is used as retaining circuit 110, the full-color display is possible in the memory operation mode.

As described above, according to this invention, a single liquid crystal display panel 100 can alternate between two display modes. The normal operation mode (analog display mode) makes the full color motion picture display. The memory operation mode (digital display mode) makes the digital gray scale display with low power consumption.

The reflective LCD, where the pixel element electrode is a reflective electrode, is preferable for this embodiment because the retaining circuit 110 can be placed under the pixel element electrode. However, it is also possible to apply this invention to the transmission type LCD by placing the transparent pixel element electrode over the retaining circuit. In the transmission type LCD however, the light is blocked at the place where the metal wiring is disposed, leading to a reduced aperture. Also, when the retaining circuit is disposed under the pixel element electrode in the transmission type LCD, it is possible for the transistors of the retaining circuit and the selection circuit to make false operation due to the transmitted light, requiring the formation of the light shield over the gate of all transistors. Therefore, it is very difficult to increase the aperture of the transmission type LCD. On the other hand, with reflective LCD, placement of any circuit under the pixel element electrode does not affect the aperture. Furthermore, unlike the transmission type LCD, the reflective LCD does not need a backlight, which is located at the opposite side of the observer. Thus, the power for the backlight is not necessary.

This invention is not limited to a liquid crystal device, but is also applicable to various types of devices including an organic EL display device and an LED display device.

The above is a detailed description of the particular embodiment of the invention which is not intended to limit the invention to the embodiment described. It is recognized that modifications within the scope of the invention will occur to a person skilled in the art. Such modifications and equivalents of the invention are intended for inclusion within the scope of this invention.

What is claimed is:

1. An active matrix display device comprising:

a plurality of gate signal lines disposed in one direction on a substrate;

a plurality of drain signal lines disposed in a direction different from the direction of the gate signal lines;

a plurality of pixel element electrodes each selected in response to a scanning signal fed from one of the gate signal lines and each provided with an image signal fed from one of the drain signal lines;

a plurality of retaining circuits disposed corresponding to the pixel element electrodes, each of the retaining circuits retaining a voltage according to the image signal;

an oscillation circuit outputting a first AC signal and a second AC signal;

a voltage booster circuit disposed on the substrate; and a plurality of circuit selection transistors each connected between the corresponding retaining circuits and the corresponding pixel element electrodes, wherein the display device has a normal operation mode in which voltages corresponding to the image signal are supplied to the pixel element electrodes, and a memory operation mode in which the first AC signal or the second AC signal corresponding to the voltage retained by the retaining circuit is supplied to a corresponding pixel element electrode, and the circuit selection transistors turning on in the memory operation mode, and the first and second AC signals supplied to the pixel element electrodes in the memory operation mode being supplied to the pixel element electrodes through the circuit selection transistors, and wherein a voltage applied to gates of the circuit selection transistors is constant and higher than a highest voltage of the first and second AC signals and is a voltage that is generated by the voltage booster circuit.

2. The active matrix display device of claim 1, wherein the voltage applied to the gate of the circuit selection transistor is higher than the highest voltage supplied to the pixel element electrodes at least by a threshold voltage of the circuit selection transistor.

3. An active matrix display device comprising:

a plurality of gate signal lines disposed in one direction on a substrate;

a plurality of drain signal lines disposed in a direction different from the direction of the gate signal lines;

a plurality of pixel element electrodes each selected in response to a scanning signal fed from one of the gate signal lines and each provided with an image signal fed from one of the drain signal lines;

a plurality of retaining circuits disposed corresponding to the pixel element electrodes, each of the retaining circuits retaining a voltage according to the image signal;

an oscillation circuit outputting a first AC signal and a second AC signal;

a voltage booster circuit disposed on the substrate; and a plurality of data output transistors, outputs of the retaining circuits being supplied to gates of corresponding data output transistors, wherein the display device has a normal operation mode in which voltages corresponding to the image signal are supplied to the pixel element electrodes, and a memory operation mode in which the data output transistors turn on according to the voltages retained by the corresponding retaining circuits and output to the pixel element electrodes the first and second AC signals; and wherein a voltage applied to gates of the data output transistors is constant and higher than a highest voltage of the first and second AC signals and is a voltage that is generated by the voltage booster circuit.

4. The active matrix display device of claim 3, wherein the voltage applied to the gate of the data output transistor is higher than the highest voltage supplied to the pixel element electrodes at least by a threshold voltage of the data output transistor.

5. An active matrix display device comprising:

a plurality of gate signal lines disposed in one direction on a substrate;

a plurality of drain signal lines disposed in a direction different from the direction of the gate signal lines;

a plurality of pixel element electrodes each selected in response to a scanning signal fed from one of the gate signal lines and each provided with an image signal fed from one of the drain signal lines;

a plurality of retaining circuits disposed corresponding to the pixel element electrodes, each of the retaining circuits retaining a voltage according to the image signal;

an oscillation circuit outputting a first AC signal and a second AC signal;

a plurality of first circuit selection transistors of N type each connected between the corresponding retaining circuits and the corresponding pixel element electrodes; and a plurality of second circuit selection transistors of P type each connected between the corresponding drain lines and the corresponding pixel element electrodes, each of the second circuit selection transistors operating complimentarily with a corresponding first circuit selection transistor, wherein the display device has a normal operation mode in which voltages corresponding to the image signal are supplied to the pixel element electrodes through the second circuit selection transistors of P type and a memory operation mode in which the first AC signal or the second AC signal corresponding to the voltage retained by the retaining circuit is supplied to a corresponding pixel element electrode through the first circuit selection transistors of N type, and wherein a voltage applied to gates of the first circuit selection transistors is constant and higher than a highest voltage of the first and second AC signals.

6. The active matrix display device of claim 5, wherein the retaining circuits are powered by a high voltage and a low voltage, and the voltage applied to gates of the first circuit selection transistors is the high voltage.

7. An active matrix display device comprising:

a plurality of gate signal lines disposed in one direction on a substrate;

a plurality of drain signal lines disposed in a direction different from the direction of the gate signal lines;

a plurality of pixel element electrodes each selected in response to a scanning signal fed from one of the gate signal lines and each provided with an image signal fed from one of the drain signal lines;

a plurality of retaining circuits disposed corresponding to the pixel element electrodes, each of the retaining circuits retaining a voltage according to the image signal;

an oscillation circuit outputting a first AC signal and a second AC signal;

a voltage booster circuit disposed on the substrate; and a plurality of circuit selection transistors each connected between the corresponding retaining circuits and the corresponding pixel element electrodes, wherein the display device has a normal operation mode in which voltages corresponding to the image signal are supplied to the pixel element electrodes to show moving images, and a memory operation mode in which the first AC signal or the second AC signal corresponding to the voltage retained by the retaining circuit is supplied to a corresponding pixel element electrodes to show a still image, and the circuit selection transistors turning on in the memory operation mode, and the first and second AC signals supplied to the pixel element electrodes in the memory operation mode being supplied to the pixel element electrodes through the circuit selection transistors, and wherein a voltage applied to gates of the circuit selection transistors is higher than a highest voltage of the first and second AC signals and is a voltage that is generated by the voltage booster circuit.

8. An active matrix display device comprising:

a plurality of gate signal lines disposed in one direction on a substrate;

a plurality of drain signal lines disposed in a direction different from the direction of the gate signal lines;

a plurality of pixel element electrodes each selected in response to a scanning signal fed from one of the gate signal lines and each provided with an image signal fed from one of the drain signal lines;

a plurality of retaining circuits disposed corresponding to the pixel element electrodes, each of the retaining circuits retaining a voltage according to the image signal;

an oscillation circuit outputting a first AC signal and a second AC signal; and a plurality of circuit selection transistors each connected between the corresponding retaining circuits and the corresponding pixel element electrodes, wherein the display device has a normal operation mode in which voltages corresponding to the image signal are supplied to the pixel element electrodes, and a memory operation mode in which the first AC signal or the second AC signal corresponding to the voltage retained by the retaining circuit is supplied to a corresponding pixel element electrode, and the circuit selection transistors turning on in the memory operation mode, and the first and second AC signals supplied to the pixel element electrodes in the memory operation mode being supplied to the pixel element electrodes through the circuit selection transistors, a voltage applied to gates of the circuit selection transistors is constant and higher than a highest voltage of the first and second AC signals, and the oscillation circuit is powered by a predetermined voltage, and the voltage applied to the gates of the circuit selection transistors is a voltage that is generated by boosting the predetermined voltage.

9. An active matrix display device comprising:

a plurality of gate signal lines disposed in one direction on a substrate;

a plurality of drain signal lines disposed in a direction different from the direction of the gate signal lines;

a plurality of pixel element electrodes each selected in response to a scanning signal fed from one of the gate signal lines and each provided with an image signal fed from one of the drain signal lines;

a plurality of retaining circuits disposed corresponding to the pixel element electrodes, each of the retaining circuits retaining a voltage according to the image signal;

an oscillation circuit outputting a first AC signal and a second AC signal; and a plurality of data output transistors, outputs of the retaining circuits being supplied to gates of corresponding data output transistors, wherein the display device has a normal operation mode in which voltages corresponding to the image signal are supplied to the pixel element electrodes, and a memory operation mode in which the data output transistors turn on according to the voltages retained by the corresponding retaining circuits and output to the pixel element electrodes the first and second AC signals, a voltage applied to gates of the data output transistors is constant and higher than a highest voltage of the first and second AC signals, and the oscillation circuit is powered by a predetermined voltage, and the voltage applied to the gates of the data output transistors is a voltage that is generated by boosting the predetermined voltage.

10. An active matrix display device comprising:

a plurality of gate signal lines disposed in one direction on a substrate;

a plurality of drain signal lines disposed in a direction different from the direction of the gate signal lines;

a plurality of pixel element electrodes each selected in response to a scanning signal fed from one of the gate signal lines and each provided with an image signal fed from one of the drain signal lines;

a plurality of retaining circuits disposed corresponding to the pixel element electrodes, each of the retaining circuits retaining a voltage according to the image signal;

an oscillation circuit outputting a first AC signal and a second AC signal; and a plurality of circuit selection transistors each connected between the corresponding retaining circuits and the corresponding pixel element electrodes, wherein the display device has a normal operation mode in which voltages corresponding to the image signal are supplied to the pixel element electrodes to show moving images, and a memory operation mode in which the first AC signal or the second AC signal corresponding to the voltage retained by the retaining circuit is supplied to a corresponding pixel element electrodes to show a still image, and the circuit selection transistors turning on in the memory operation mode, and the first and second AC signals supplied to the pixel element electrodes in the memory operation mode being supplied to the pixel element electrodes through the circuit selection transistors, a voltage applied to gates of the circuit selection transistors is higher than a highest voltage of the first and second AC signals, and the oscillation circuit is powered by a predetermined voltage, and the voltage applied to the gates of the circuit selection transistors is a voltage that is generated by boosting the predetermined voltage.

11. An active matrix display device comprising:

a plurality of gate signal lines disposed in one direction on a substrate;

a plurality of drain signal lines disposed in a direction different from the direction of the gate signal lines;

a plurality of pixel element electrodes each selected in response to a scanning signal fed from one of the gate signal lines and each provided with an image signal fed from one of the drain signal lines;

a plurality of retaining circuits disposed corresponding to the pixel element electrodes, each of the retaining circuits retaining a voltage according to the image signal;

an oscillation circuit outputting a first AC signal and a second AC signal;

a plurality of data output transistors, outputs of the retaining circuits being supplied to gates of corresponding data output transistors; and a plurality of circuit selection transistors, each of the circuit selection transistors being connected between a corresponding data output transistor and a corresponding pixel element electrode;

wherein the display device has a normal operation mode in which voltages corresponding to the image signal are supplied to the pixel element electrodes, and a memory operation mode in which the data output transistors turn on according to the voltages retained by the corresponding retaining circuits and output the first and second AC signals to the pixel element electrodes through the circuit selection transistors, and a voltage applied to gates of the data output transistors is constant and higher than a highest voltage of the first and second AC signals, and a voltage applied to gates of the circuit selection transistors is constant and higher than a highest voltage of the first and second AC signals.

12. An active matrix display device comprising:

a plurality of gate signal lines disposed in one direction on a substrate;

a plurality of drain signal lines disposed in a direction different from the direction of the gate signal lines;

a plurality of pixel element electrodes each selected in response to a scanning signal fed from one of the gate signal lines and each provided with an image signal fed from one of the drain signal lines;

a plurality of retaining circuits disposed corresponding to the pixel element electrodes, each of the retaining circuits retaining a voltage according to the image signal;

an oscillation circuit outputting a first AC signal and a second AC signal;

a plurality of first circuit selection transistors of N type each connected between the corresponding retaining circuits and the corresponding pixel element electrodes; and a plurality of second circuit selection transistors of P type each connected between the corresponding drain lines and the corresponding pixel element electrodes, wherein the display device has a normal operation mode in which voltages corresponding to the image signal are supplied to the pixel element electrodes through the second circuit selection transistors of P type and a memory operation mode in which the first AC signal or the second AC signal corresponding to the voltage retained by the retaining circuit is supplied to a corresponding pixel element electrode through the first circuit selection transistors of N type, a voltage applied to gates of the first circuit selection transistors is constant and higher than a highest voltage of the first and second AC signals, and the oscillation circuit is powered by a predetermined voltage, and the voltage applied to the gates of the first circuit selection transistors is a voltage that is generated by boosting the predetermined voltage.

13. An active matrix display device comprising:

a plurality of gate signal lines disposed in one direction on a substrate;

a plurality of drain signal lines disposed in a direction different from the direction of the gate signal lines;

a plurality of pixel element electrodes each selected in response to a scanning signal fed from one of the gate signal lines and each provided with an image signal fed from one of the drain signal lines;

a plurality of retaining circuits disposed corresponding to the pixel element electrodes, each of the retaining circuits retaining a voltage according to the image signal;

an oscillation circuit outputting a first AC signal and a second AC signal;

a plurality of first circuit selection transistors of N type each connected between the corresponding retaining circuits and the corresponding pixel element electrodes;

a plurality of second circuit selection transistors of P type each connected between the corresponding drain lines and the corresponding pixel element electrodes and a voltage booster circuit disposed on the substrate;

wherein the display device has a normal operation mode in which voltages corresponding to the image signal are supplied to the pixel element electrodes through the second circuit selection transistors of P type and a memory operation mode in which the first AC signal or the second AC signal corresponding to the voltage retained by the retaining circuit is supplied to a corresponding pixel element electrode through the first circuit selection transistors of N type, a voltage applied to gates of the first circuit selection transistors is constant and higher than a highest voltage of the first and second AC signals, and the retaining circuits are powered by a high voltage and a low voltage, the high voltage is generated by the voltage booster circuit, and the voltage applied to gates of the first circuit selection transistors is the high voltage.

* * * * *